US005413043A

United States Patent [19]

Fuhrmann et al.

[11] Patent Number: 5,413,043

[45] Date of Patent: May 9, 1995

[54] PRINTING APPARATUS INCLUDING A FORME CYLINDER AND METHOD OF PREPARING THE FORME CYLINDER FOR PRINTING

[75] Inventors: Hartmut Fuhrmann, Bobingen; Josef Göttling, Friedberg; Wolfram Fischer, Neusäss, all of Germany

[73] Assignee: MAN Roland Druckmaschinen AG, Offenbach am Main, Germany

[21] Appl. No.: 49,179

[22] Filed: Apr. 19, 1993

[30] Foreign Application Priority Data

Apr. 24, 1992 [DE] Germany ..... 42 13 503.6

[51] Int. Cl.[6] ..... B41F 27/12

[52] U.S. Cl. ..... 101/415.1; 101/216; 101/378; 101/382.1

[58] Field of Search ..... 101/415.1, 382.1, 383, 101/389.1, 216, 217, 375, 376, 377, 378; 51/358, 364–369

[56] References Cited

U.S. PATENT DOCUMENTS

| | | | |
|---|---|---|---|
| 3,491,684 | 1/1970 | Borinsky | 101/132 |
| 3,691,950 | 9/1972 | Gates | 101/415.1 |
| 3,750,573 | 8/1973 | Haeusler et al. | 101/415.1 |
| 3,828,672 | 8/1974 | Gazzola et al. | 101/415.1 |
| 4,116,022 | 9/1978 | Lopata et al. | 101/470 |
| 4,183,299 | 1/1980 | Cappel | 101/415.1 |
| 4,368,668 | 1/1983 | Johne et al. | 101/415.1 |
| 4,377,974 | 3/1983 | Kirkpatrick | 101/415.1 |
| 4,510,868 | 4/1985 | Fischer | 101/375 |
| 4,815,380 | 3/1989 | Fischer | 101/415.1 |
| 4,829,896 | 5/1989 | Norkus | 101/415.1 |
| 4,856,428 | 8/1989 | Green et al. | 101/389.1 |
| 5,072,671 | 12/1991 | Schneider et al. | 101/467 |
| 5,090,319 | 2/1992 | Weber et al. | 101/415.1 |
| 5,142,978 | 9/1992 | Borel | 101/352 |

FOREIGN PATENT DOCUMENTS

| | | |
|---|---|---|
| 3338450C1 | 6/1985 | Germany . |
| 3542649A1 | 6/1987 | Germany . |
| 4110309A1 | 10/1991 | Germany . |
| 2-229046A | 9/1990 | Japan . |

OTHER PUBLICATIONS

Xerox Disclosure Journal B41M5/26D2 (1 page) vol. 1 No. 4 Apr. 1976 "Process for Preparing Printing Masters", Robert N. Jones.

*Primary Examiner*—Edgar S. Burr
*Assistant Examiner*—Lynn D. Hendrickson
*Attorney, Agent, or Firm*—Cohen, Pontani, Lieberman, Pavane

[57] ABSTRACT

The printing apparatus with a forme cylinder which has in its interior a first roller for winding off a printing foil which can be pulled onto the outer surface of the forme cylinder, and a second roller for winding up the printing foil which has been pulled onto the outer surface of the forme cylinder. The forme cylinder has in its outer surface a single opening for a recess into the interior of the forme cylinder. The first roller and the second roller are together arranged in the recess. The printing foil can be wound from the first roller onto the outer surface of the forme cylinder and from the outer surface onto the second roller.

24 Claims, 4 Drawing Sheets

PRINTING APPARATUS INCLUDING A FORME CYLINDER AND METHOD OF PREPARING THE FORME CYLINDER FOR PRINTING

BACKGROUND OF THE INVENTION

1. Field of the Invention

The present invention relates to a printing apparatus with a forme cylinder. The forme cylinder has in its interior a first roller for winding off a printing foil which can be pulled onto the outer surface of the forme cylinder, and a second roller for winding up the printing foil which has been pulled onto the outer surface of the forme cylinder.

The invention additionally relates to methods of preparing the forme cylinder for printing.

2. Description of the Related Art

Xerox Disclosure Journal, Volume 1, Number 4, Page 19 (1976), discloses the use of a thin exchangeable printing foil in lithographic printing processes. The printing foil is stored in the interior of a forme cylinder of a printing apparatus. The forme cylinder has in its interior a first and a second roller, and the printing foil which has not yet been used is wound onto the first roller and the printing foil which has been used for printing is wound onto the second roller. The first roller is accommodated within an interior space of the forme cylinder which is connected through a first opening with the outer surface of the forme cylinder. The printing foil exits through this first opening from the first roller onto the outer surface of the forme cylinder, the printing foil is then wound once around the forme cylinder and enters through a second opening a second interior space which contains the second roller. In this printing apparatus, it is possible that the printing foil which is on the outer surface of the forme cylinder contains an image to be printed and, after the foil has been used, is wound up from the outer surface of the forme cylinder onto the second roller, while simultaneously printing foil is wound from the first roller onto the outer surface of the forme cylinder. The printing foil which now covers the outer surface of the forme cylinder forms the foundation for a lithographic writing process which is used to apply a new image to be printed onto the printing foil, for example, by means of a laser writing system.

The known printing apparatus has the disadvantage that the outer surface of the forme cylinder has two openings, so that the smaller of the two area portions of the outer surface resulting from the two openings cannot be utilized for the printing process because this area portion is not covered with printing foil.

SUMMARY OF THE INVENTION

Therefore, it is the primary object of the present invention to provide a printing apparatus which is of simple construction and in which the printing foil can be easily exchanged.

In accordance with the present invention, in a printing apparatus of the above-described type, the forme cylinder has in its outer surface a single opening for a recess or trough in the interior of the forme cylinder. The first roller and the second roller are together arranged in the recess. The printing foil can be wound from the first roller onto the outer surface of the forme cylinder and from the outer surface onto the second roller.

Another object of the present invention is to provide a method of preparing the forme cylinder for printing, wherein a problem-free replacement of the printing foil is possible.

In accordance with the method of the present invention, a supply roll with printing foil wound thereon is moved by a feeding device toward the forme cylinder. Subsequently, a first end of the printing foil is clamped to the first roller and a first portion of the printing foil is wound from the supply roll onto the first roller. The forme cylinder then carries out an almost complete rotation while a second portion of the printing foil is wound onto the outer surface of the forme cylinder. Subsequently, a second end of the printing foil is clamped to the second roller.

The printing apparatus according to the present invention has the advantage that the rollers for receiving the printing foil are arranged in the interior of the forme cylinder in a single recess, so that they can be mounted in the recess either next to each other or one on top of the other and can be moved together in and out of the recess from the outside.

In accordance with an advantageous further development of the invention, the rollers are mounted in a cassette. Thus, the rollers can be moved together with the cassette out of the forme cylinder, so that it is not necessary to newly support them each time they are mounted in the forme cylinder.

The rollers can be inserted into the recess either through the opening in the outer surface of the forme cylinder. In this case, the opening must have at least the same width as the diameter of the rollers. The forme cylinder also may have an opening in one of the end faces thereof through which the rollers can be inserted into the interior of the forme cylinder either individually or in the cassette. In this case, the opening in the outer surface advantageously is constructed as a narrow slot, so that only a small portion of the outer surface of the forme cylinder is lost, while the predominant portion of the outer surface of the forme cylinder is covered by the printing foil with the image to be printed. It is also conceivable to mount the rollers in the forme cylinder during the assembly thereof and to supply only the printing foil to that roller through a slot in the outer surface. Accordingly, this embodiment is particularly suitable for web printing methods, while the embodiment mentioned first is more suitable for sheet printing methods because a greater reduction in the useful portion of the outer surface is acceptable.

In both cases, the opening may be small when the printing foil being used is thin. It is a particular advantage of the present invention that the use of a very thin printing foil is possible because the printing foil is not removed during the exchange of a printing image and a new printing foil is supplied subsequently, which would require a high mechanical stability. Rather, the printing foil is exchanged by rotating the rollers. The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there is illustrated and described a preferred embodiment of the invention.

DESCRIPTION OF THE PREFERRED EMBODIMENT

Figure 1:
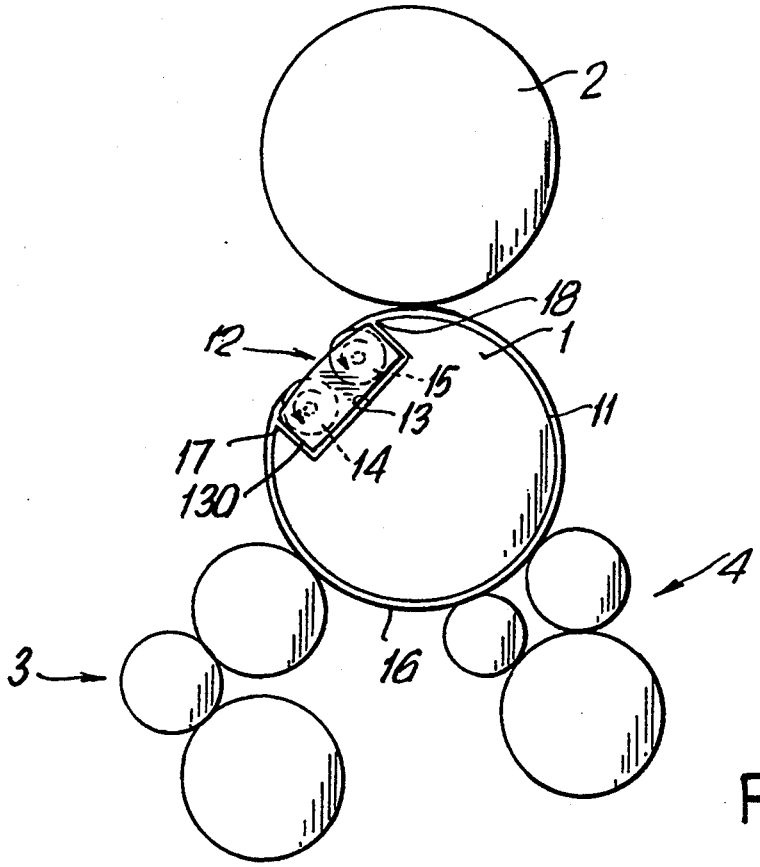
FIG. 1 is a schematic view of a printing apparatus with a forme cylinder including two rollers arranged next to each other below the outer surface of the forme cylinder.

As illustrated in FIG. 1 of the drawing, a printing apparatus includes a forme cylinder 1, a rubber blanket cylinder 2, a clampening device 3 and an inking device 4. The forme cylinder 1 has an outer surface 11 with an opening 12 The opening 12 is in communication with a recess or groove 13 in the interior of the forme cylinder 1. In the illustrated embodiment, the groove 13 has the same width as the opening 12. In other embodiments, the opening 12 may be substantially smaller than the groove 13 and may be in the form of a narrow slot.

Two rollers 14, 15 are rotatably mounted in the groove 13. The rollers 14, 15 preferably have almost the same length as the forme cylinder 1. However, the size of the rollers 14, 15 may also be different in dependence on the respective requirements. Several layers of a printing foil 16 are wound onto the roller 14. The printing foil 16 is being pulled from the roller 14 over an edge 17 onto the outer surface 11 of the forme cylinder 1 and is wound over an edge 18 at the other end onto the roller 15. The printing foil 16 has on its outer surface images to be printed and the foil is wound successively as the images are being printed off from the roller 14 onto the outer surface 11 and from the outer surface 11 onto the roller 15.

The forme cylinder 1 may also be constructed in such a way that that portion which contains the groove 13 and the rollers 14, 15 is connected by suitable clamping devices to the remaining body of the forme cylinder and can be replaced against another cylinder portion, so that conventional printing plates can also be used in the printing apparatus. The slot which may be created between the two portions in the outer surface 11 can be closed by a suitable plastics material and can be made plane, so that it cannot be seen in the printed image.

Instead of mounting the rollers 14, 15 in the interior of the forme cylinder 1 proper, it is also possible to arrange the rollers in a cassette, 130. As a result, the removal of the rollers 14, 15 is simplified because the entire cassette can be pulled out of the interior of the forme cylinder 1 and it is not necessary to once again align the rollers 14, 15 in their bearings.

Figure 2:
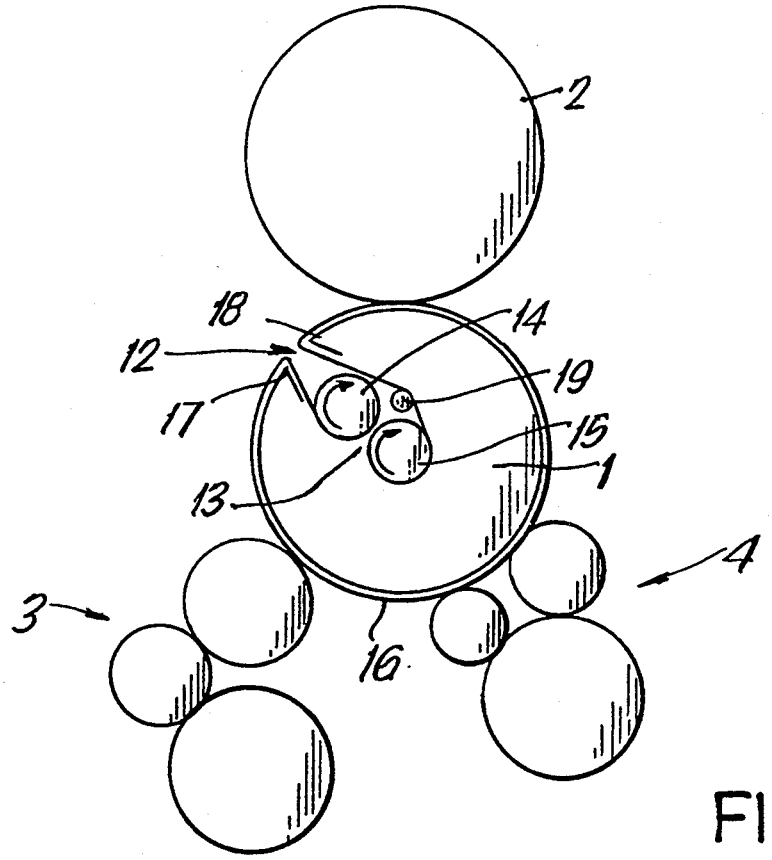
FIG. 2 is a schematic view of a printing apparatus with a forme cylinder including two rollers mounted radially, one below the other.

In the embodiment of the printing apparatus illustrated in FIG. 1, it is possible to move the rollers 14, 15 individually into and out of the groove 13 through the opening 12. In the embodiment illustrated in FIG. 2, the rollers 14, 15 are mounted in the groove 13 radially one behind the other, i.e., the rollers are mounted one behind the other in the direction of the radius of the forme cylinder 1. A guide roller 19 ensures that the portion of the printing foil 16 to be wound onto the roller 15 does not contact the roller 14. In this embodiment, the opening 13 is a narrow slot which occupies an only insignificant portion of the outer surface 11 of the forme cylinder 1 and, therefore, the predominant portion of the outer surface 11 is available for receiving an image to be printed on the printing foil 16. In this case, the rollers 14, 15 are accessible through an opening in one of the end faces of the forme cylinder 1. The rollers 14, 15 can either be removed out of the forme cylinder 1 individually through the end face or out of the groove 13 through the opening 12, or they are arranged in a cassette and can be removed together with the cassette, or the rollers 14, 15 are fixedly mounted in the forme cylinder 1, so that only the printing foil 16 can be taken from the roller 15 after the foil has been printed off. Subsequently, the printing foil 16 is introduced into the interior of the forme cylinder 1 through the opening in the end face or through the opening 12 in the outer surface 11 and the printing foil 16 is attached to the roller 14, is wound onto the roller 14, is wound around the outer surface 11 and is again pulled back through the opening 12, is fastened in roller 15 and, depending on the use, is also wound back onto roller 15. In order to further transport the printing foil onto the rollers 14, 15, at least the roller 15 has a drive unit, for example, a servomotor. The ends of the printing foil 16 are preferably fastened in slots, not shown, in the rollers 14, 15. However, it is also possible to fasten the printing foil 16 on the rollers 14, 15 differently, for example, by means of an adhesive.

Figure 8:
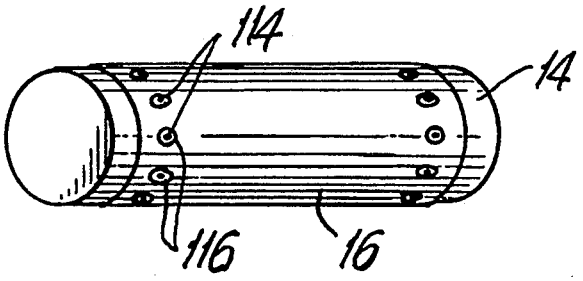
FIG. 8 shows a detailed view of a roller with a printing foil thereon.

As shown in FIG. 8, the rollers 14, 15 are preferably provided with pins 114 on the outer surfaces thereof in the vicinity of the edges with the end faces thereof. The printing foil 16, on the other hand, has holes 116 whose shape corresponds to the cross section of the pins, so that the pins extend into the holes of the printing foil 16 and hold the printing foil 16. As a result, the printing foil 16 can be easily wound onto the outer surface 11 of the forme cylinder 1. Particularly if the printing foil contains the images to be printed already when wound onto the roller 15, so that the images are successively wound onto the outer surface 11, an adjustment with exact fit of the images to be printed is necessary on the outer surface 11. However, also if the images to be printed are applied first on the outer surface 11 from the outside, for example, by means of a laser beam or by thermal treatment of the printing foil 16, the accurate guidance of the printing foil 16 by means of the pins is an advantage. In addition to the rollers 14, 15, the outer surface 11 of the forme cylinder 1 may also have corresponding pins. The pins on the outer surface 11 may be retractable against the force of springs if these pins represent an obstacle when the foil is rolled over by the blanket cylinder 2.

Figure 3:
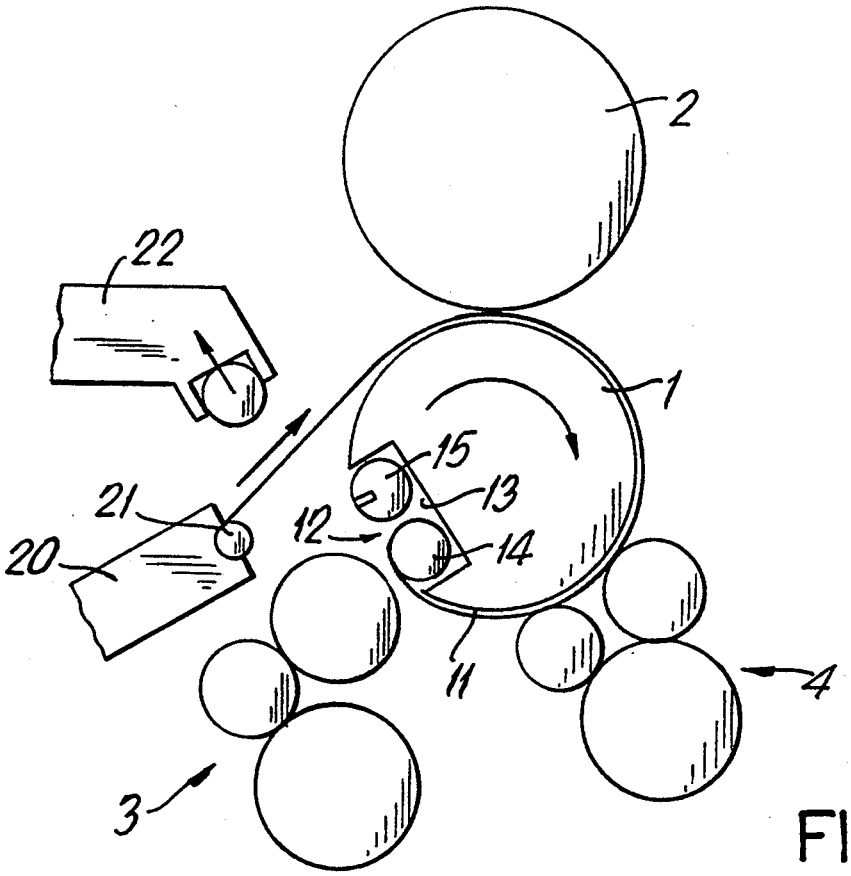
FIG. 3 is a schematic view of the printing apparatus of FIG. 1 shown during winding of a new printing foil onto the forme cylinder.

FIG. 3 of the drawing shows the replacement of a printing foil 16 which has been printed off by a new printing foil 16 in the printing apparatus of FIG. 1. In the illustrated embodiment, the roller 15 is arranged so as to be replaceable. A swivel arm 20 serves as feeding device. The swivel arm 20 has at its outer end a supply roll 21 onto which is wound an unprinted new printing foil 16. The swivel arm 20 is moved toward the forme cylinder 1, so that a first end of the new printing foil 16 can be pulled out of the supply roll 21 and clamped in a fastening means of the roller 14. Subsequently, by means of a motor, not shown, the foil is wound onto the roller 14 and is finally placed on the outer surface 11 of the forme cylinder 1 by a rotation of the forme cylinder 1 in the direction indicated by an arrow. After the used printing foil 16 has been wound onto the roller 15, a linearly displaceable gripping unit 2 pulls the roller 15 out of the groove 13. Subsequently, the gripping unit 2 inserts into the groove 13 another roller 15 onto which no foil has yet been wound. The drawing schematically indicates the removal of the roller 15 with the used printing foil 16.

After the new printing foil 16 has been substantially wound onto the roller 14, the forme cylinder 1 carries out an almost full rotation.

Figure 4:
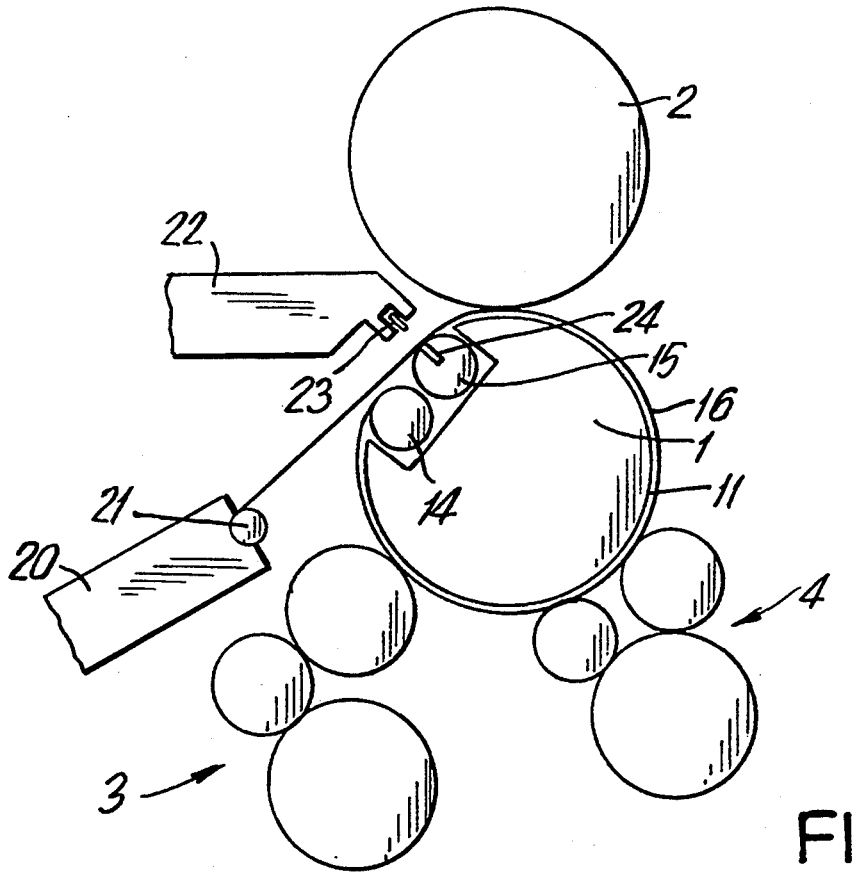
FIG. 4 is a schematic view of the printing apparatus shown during clamping of the printing foil into a recess of a second of the two rollers when the exchange of printing foil is concluded.

Subsequently, as illustrated in FIG. 4, the gripping unit 22 presses a plug 23 through the printing foil 16 into a corresponding recess 24 in the roller 15, so that the end of the printing foil 16 is clamped to the roller 15 and the end portion of the printing foil 16 behind the recess 24 can be removed.

Figure 5:
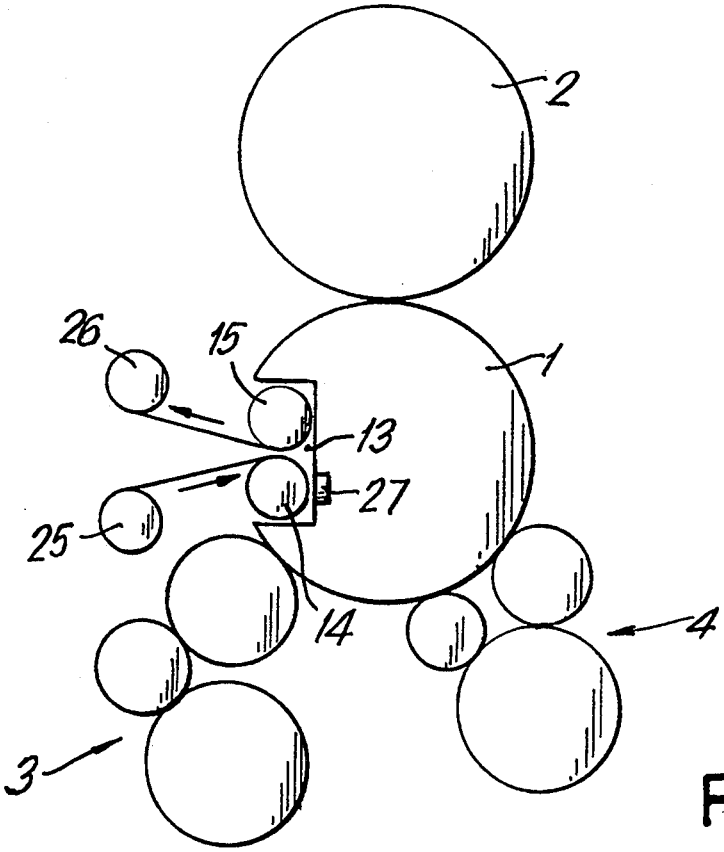
FIG. 5 is a schematic view of the printing apparatus of FIG. 1 showing the exchange of the printing foil.

In the embodiment illustrated in FIG. 5, the rollers 15, 16 are mounted in the forme cylinder 16 so as to be moveable but not removable. By using arrangements similar to the swivel arm 20 and the gripping unit 22 shown in FIGS. 3 and 4, rollers 25, 26 can be moved toward the forme cylinder 1. The new printing foil 16 is wound onto the roller 25. The end of the printing foil 16 is clamped to the roller 14, for example, by means of a plug which is pushed into a recess in the manner illustrated in FIG. 4. The printing foil 16 is then wound onto the roller 14. For this purpose, the roller 14 is provided with a drive 27. In a similar manner, the used printing foil 16 is wound from the roller 15 onto the roller 26. For this purpose, the roller 26 also has a drive unit. After the new printing foil 16 has been wound almost completely onto the roller 14, the printing foil 16 is wound around the forme cylinder 1 and is clamped to the roller 15, as illustrated, for example, in connection with FIG. 4.

Figure 6:
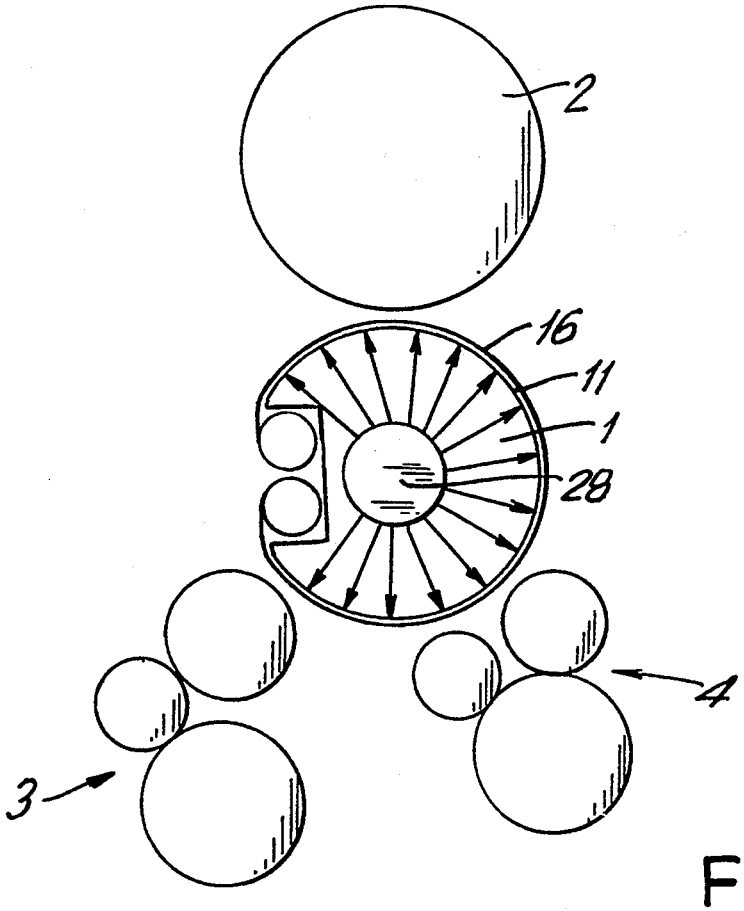
FIG. 6 is a schematic view of a printing apparatus with a forme cylinder including a pneumatic device.

In another embodiment shown in FIG. 6, the printing apparatus includes a pneumatic device 28 in the forme cylinder 1. The pneumatic device 28 either draws in air or discharges air to the outside. Accordingly, the material of the forme cylinder 1 between the pneumatic device 28 and the outer surface 11 either is a porous material, for example, a sintered material such as sintered bronze, or the forme cylinder 1 has radially extending ducts through which the air can flow. Thus, when the pneumatic device 28 draws in air, the printing foil 16 is tightly pressed against the outer surface 11 and slippage or distortion of the printing foil 16 is prevented. On the other hand, when the pneumatic device 28 discharges air, an air cushion is formed between the outer surface 11 and the printing foil 16, so that, just after another image has been printed, the printing foil 16 can be easily further transported from the roller 14 onto the roller 15. Subsequently, the pneumatic device again draws in air and presses the printing foil 16 against the outer surface 11.

The printing foil 16 either has already a plurality of pre-printed printing images, or the printing foil 16 is completely unprinted and is placed on the forme cylinder 1 and then an image to be printed is written onto the printing foil 16, for example by a laser writing system or a thermal writing system. When these two methods for writing on the printing foil 16 are combined with each other, the printing foil is wound in the partially pre-printed state onto the roller 14 and, after the printing foil 16 has been placed on the forme cylinder 1, images to be printed are written onto portions of the printing foil 16 by one of the above-described methods.

Since the printing foil 16 may be composed of a very thin material, for example, with a thickness of less than 50 μm, the printing foil 16 adapts very well to the surface structure of the outer surface 11 of the forme cylinder 1. Accordingly, when the outer surface 11 is formed by the surface of a rubber layer which covers the forme cylinder 1 from the outside, the forme cylinder 1 together with the printing foil 16 are also suitable for direct printing methods. In other words, the blanket cylinder 2 becomes unnecessary. Other elastic materials are also suitable instead of the rubber layer.

Figure 7:
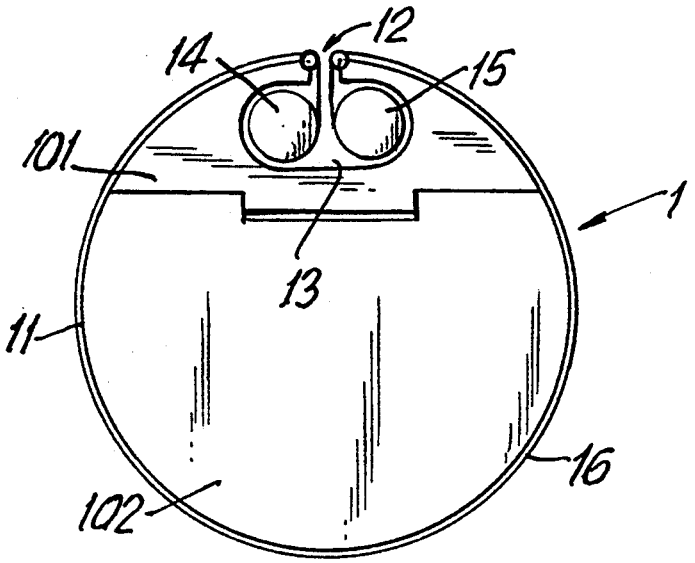
FIG. 7 is a schematic view of a forme cylinder composed of two segments.

In accordance with a further embodiment of the invention illustrated in FIG. 7, the forme cylinder 1 is composed of two segments 101 and 102. The opening 12 and the groove 13 are provided in the segment 101. Clamping devices connect the segment 101 with the segment 102. The segment 101 may also be exchangeable and replaced by a segment which does not have an opening 12 or a groove 13, so that conventional printing plates can also be used in this printing apparatus.

In conventional printing machines, the forme cylinders and printing cylinders are displaced or rotated axially, circumferentially or diagonally, i.e., obliquely, in order to adjust lateral registers, circumferential registers and diagonal registers. In the printing apparatus according to the present invention, these adjustments are advantageously carried out on the rollers 14, 15, i.e., the rollers 14, 15 are preferably axially displaceable together and/or moveable back and forth in circumferential direction and/or adjustable in an oblique direction. If cassettes are used instead of the rollers, these adjustments are carried out in the equivalent manner on the cassettes. However, the foil may preferably be raised from the outer surface 11 by means of an air cushion, i.e., by air blown out of the cylinder 1, as illustrated in FIG. 6.

The measures required for carrying out these adjustments are generally known. In other words, those skilled in the art of manufacturing new printing machines are familiar with movably arranged or supported rollers or cylinders because such rollers and cylinders are used in almost all printing machines. For example, the rollers 14, 15 may be axially displaceable in bearings on both sides by means of an electric servomotor and may be rotated by means of another servomotor which engages a gear wheel on the axis of the roller to be rotated. Also, if the axis of a roller to be obliquely adjusted are mounted on both sides in individually swingable levers or arms, of any design diagonal or oblique adjustment can be carried out easily.

It should be understood that the preferred embodiments and examples described are for illustrative purposes only and are not to be construed as limiting the scope of the present invention which is properly delineated only in the appended claims.

We claim:

1. A printing apparatus comprising a forme cylinder, the forme cylinder having an outer circumferential surface and end faces, the outer surface defining a single opening, the forme cylinder having a groove in communication with the single opening, a first roller mounted in the groove and a second roller mounted in the groove, and a printing foil provided on the first roller and windable off the first roller through the opening onto the outer surface of the forme cylinder, around the outer surface of the forme cylinder, through the opening and onto the second roller, the printing foil being windable by rotation of the rollers.

2. The printing apparatus according to claim 1, wherein the forme cylinder comprises a first segment and a second segment, means for separating the first and second segments from each other, wherein the first segment comprises the opening and the groove.

3. The printing apparatus according to claim 1, further comprising a cassette mounted in the groove of the forme cylinder, the first and second rollers being movably mounted in the cassette.

4. The printing apparatus according to claim 1, wherein the opening has a width and the first and second rollers have a diameter, the width of the opening being at least equal to the diameter of the rollers, so that the rollers can be inserted through the opening into the groove.

5. The printing apparatus according to claim 1, wherein one of the end faces of the forme cylinder has an opening in communication with the groove, so that the first and second rollers can be inserted in the groove through the opening in the end face.

6. The printing apparatus according to claim 1, further comprising a drive means for driving at least one of the second roller for winding the printing foil from the first roller and the first roller for winding the printing foil from a supply roll.

7. The printing apparatus according to claim 1, wherein the printing foil has first and second ends, the first and second rollers each having a fastening means for fastening the first and second ends of the printing foil.

8. The printing apparatus according to claim 7, wherein the first and second rollers have outer surfaces and side edges, the fastening means being mounted on the outer surfaces of the rollers at the side edges thereof.

9. The printing apparatus according to claim 7, wherein the forme cylinder comprises fastening means for the printing foil at side edges of the forme cylinder.

10. The printing apparatus according to claim 8, wherein the fastening means on the first and second rollers comprise pins, the printing foil having a plurality of holes at side edges thereof, the pins having a cross section, wherein the shape of the holes corresponds to the cross section of the pins and the pins project into the holes.

11. The printing apparatus according to claim 1, wherein the outer surface of the forme cylinder comprises a cover of elastic material.

12. The printing apparatus according to claim 11, wherein the elastic material is rubber.

13. The printing apparatus according to claim 1, wherein the forme cylinder is of an air-permeable material, further comprising a pneumatic device in the forme cylinder for producing one of a negative pressure and excess pressure between the outer surface of the forme cylinder and the printing foil.

14. A method of preparing a forme cylinder of a printing apparatus for printing, comprising providing a forme cylinder having an outer circumferential surface, providing a groove in the outer surface of the forme cylinder and first and second rollers mounted in said groove, means of a feeding device a supply roll with printing foil wound thereon toward the forme cylinder, clamping a first end of the printing foil to the first roller, winding a first portion of the printing foil from the supply roll onto the first roller, subsequently rotating the forme cylinder by an almost complete rotation during which rotation a second portion of the printing foil is wound onto the outer surface of the forme cylinder, clamping a second end of the printing foil to the second roller, and subsequently rotating the first and second rollers to move the foil along the outer surface of the forme cylinder.

15. The method according to claim 14, further comprising producing an air cushion between the outer surface of the forme cylinder and the printing foil during the rotation of the forme cylinder.

16. A method of preparing a forme cylinder of a printing apparatus for printing, comprising providing a forme cylinder having an outer circumferential surface and a groove formed in the outer surface of the forme cylinder, placing a first roller and a second roller ill a cassette, wherein a printing foil is wound onto the first roller, moving the cassette by means of a swivel arm into the groove of the forme cylinder, pulling by means of a gripping device a second end of the printing foil from the first roller out of the groove, subsequently rotating the forme cylinder by an almost complete rotation during which rotation the printing foil is wound onto the outer surface of the forme cylinder, passing the printing foil into the groove and subsequently clamping the second end of the printing foil to the second roller.

17. The method according to claim 16, further comprising producing an air cushion between the outer surface of the forme cylinder and the printing foil during the rotation of the forme cylinder.

18. The printing apparatus according to claim 1, comprising an adjustment means for adjusting the first and second rollers together relative to the forme cylinder for a register adjustment.

19. The printing apparatus according to claim 18, wherein the adjustment means carries out an adjustment in axial direction.

20. The printing apparatus according to claim 18, wherein the adjustment means carries out an adjustment in circumferential direction.

21. The printing apparatus according to claim 18, wherein the adjustment means carries out an adjustment in diagonal direction.

22. A printing apparatus according to claim 1, and further comprising means for writing on the printing foil.

23. A printing apparatus according to claim 22, wherein, the printing means is a laser writing system.

24. A printing apparatus according to claim 22, wherein the writing means is a thermal writing system.

* * * * *